US005352358A

United States Patent [19]

Davey

[11] Patent Number: 5,352,358

[45] Date of Patent: Oct. 4, 1994

[54] VACUUM HOSE MANIPULATOR TOOL

[76] Inventor: Wayne C. Davey, 4493 Rainbow Vista Dr., Fallbrook, Calif. 92028

[21] Appl. No.: 87,870

[22] Filed: Jul. 9, 1993

[51] Int. Cl.[5] ..... E04H 3/20

[52] U.S. Cl. ..... 210/169; 210/238; 210/416.2; 15/1.7; 4/490; 4/496

[58] Field of Search ..... 210/169, 416.2, 238, 210/470, 471; 15/1.7; 4/490, 496

[56] References Cited

U.S. PATENT DOCUMENTS

| | | | |
|---|---|---|---|
| 3,443,264 | 5/1969 | Miller | 210/169 |
| 4,221,662 | 9/1980 | Joseph | 210/169 |
| 4,443,899 | 4/1984 | Johnson | 15/1.7 |
| 4,692,956 | 9/1987 | Kassis | 15/1.7 |
| 5,082,028 | 1/1992 | Jean-Jacques | 15/1.7 |

OTHER PUBLICATIONS

Hayward Pool and Spa Products 1992 Catalog; p. 38 ©1991; PLC-92.

*Primary Examiner*—Peter A. Hruskoci
*Assistant Examiner*—Robert James Popovics
*Attorney, Agent, or Firm*—John T. Matlago

[57] ABSTRACT

A tool for remotely manipulating an auxiliary cuff provided on the end of a flexible vacuum hose of a portable pool cleaner residing on the floor of a swimming pool. The tool comprises an elongated handle having its lower end pivotally held on the auxiliary cuff so that it lies against the flexible vacuum hose when in a storage position. By rotating the elongated handle so that it extends forwardly of the auxiliary cuff, the operator can insert the end of the handle into the inlet of the skimmer so that it extends out of the top opening thereof. Then, by holding the upper end of the handle the operator can remotely direct and insert the auxiliary cuff down into the suction outlet of the skimmer. The operator can then remotely remove the auxiliary cuff from the suction outlet by reversing the procedure.

5 Claims, 4 Drawing Sheets

33
34
35
32
36
37
49
47
40
41
42
43
44
45
46
48
50
51
52
4a
5

VACUUM HOSE MANIPULATOR TOOL

This invention relates to tools useful when cleaning swimming pools and more particularly to a vacuum hose manipulator tool for remotely engaging the end of a vacuum hose of a portable vacuum cleaner to the suction outlet of a skimmer of a swimming pool.

BACKGROUND OF THE INVENTION

Swimming pool installations are commonly provided with one or more skimmers adjacent the sidewall of the pool. Each of the skimmers has an upper chamber with a skimming inlet for receiving water from the surface of the pool as controlled by a floating weir therein and a lower chamber with a leaf basket therein and a suction outlet on the bottom thereof which is connected by a line to the inlet of a pump-filter assembly located adjacent the decking of the pool. It is also common practice to provide a main drain suction outlet on the floor of the pool which is connected by a line to the inlet of the same pump-filter assembly used for the skimmers. A control valve in the line from the main drain is manually set by the pool operator to regulate the amount of vacuum of the pump that is provided at the suction outlet of the skimmers and at the suction outlet of the main drain during normal operation of the swimming pool.

Thus, when the pump is running, during normal operation of the swimming pool, water from the surface of the pool carrying leaves and other floating debris is drawn into the skimming inlets of the skimmers and passes through the leaf baskets located within the skimmers which collect the floating debris before the water is discharged through the suction outlets of the skimmers to the pump-filter assembly. Simultaneously, the water drawn from the floor of the pool carrying silt and other debris is discharged down through the main drain suction outlet to the same pump-filter assembly. After this water is passed through the filter, it is recirculated back into the swimming pool by way of a line leading to inlets provided on the sidewalls of the pool.

When it is desired to vacuum the floor and sidewalls of the above-described swimming pool installation, it is common practice for a pool technician to completely close the manually controlled valve in the line from the main drain suction outlet and also to plug off the suction outlets of all but one of the skimmers. In this way all the vacuum supplied by the pump is made available at the suction outlet of one skimmer that is selected for use. The pool technician then places on the floor of the pool a portable vacuum cleaner having connected thereto a flexible vacuum hose with a cuff on the end thereof. The pool technician, after submerging the cuff to fill the flexible hose with water, holds onto the end portion of the flexible hose with the fingers of his one hand and pushes the cuff through the skimming inlet of the skimmer so that by reaching his other hand down into the top opening of the skimmer he can grab hold of the cuff and then further extend his hand in the water in the skimmer, usually up to his elbow or higher, so as to engage the cuff into-the suction outlet on the bottom of the skimmer. This need for the pool technician to extend his hand up to his elbow in the water of the skimmer is a great inconvenience and is especially a problem in the winter months when the water in the pool can be very cold. It should now be clear that it would by highly desirable and less of a nuisance if the pool technician were to have at his disposal a tool that would enable him to remotely engage the cuff on the end of the flexible vacuum hose to the suction outlet of the skimmer without having to submerge his hand up to his elbow in the body of water in the skimmer.

SUMMARY OF THE INVENTION

In view of the above, a vacuum hose manipulator tool is provided which can be readily attached to a standard cuff normally provided on the end of a flexible vacuum hose of a portable vacuum cleaner and enables an operator to remotely engage the vacuum hose to the suction outlet of a skimmer of a swimming pool. The manipulator tool comprises an auxiliary cuff having an elongated handle which is pivotally attached by a pair of integral arms to the sides thereof. The elongated handle is formed with an inner wall along the length thereof that is transversely curved so that when the tool is not in use, or the portable vacuum cleaner is in transport, the elongated handle can be rotated into a rest position with its inner wall lying adjacent the flexible vacuum hose and held there by a hook and loop fastener, "VELCRO", for example.

When in use, the elongated handle is rotated on its pivotally held integral arms away from its rest position such that its free end extends forwardly of the outer end of the auxiliary cuff. An axially aligned stop provided on the outer surface of the auxiliary cuff limits the rotation of the elongated handle to 180° from its rest position against the flexible hose.

In operation, the pool technician, by holding on to the end portion of the flexible hose with the fingers of his one hand, submerges the auxiliary cuff into the pool to fill the hose with water, and keeps it submerged while pushing the free end of the elongated handle through the skimming inlet of the skimmer and up through the opening provided in the top thereof. The pool technician, then, by holding on to the exposed end of the elongated handle with his other hand, first pulls the auxiliary cuff into the interior of the skimmer and then pushes it downwardly so that it engages the suction outlet in the bottom of the skimmer. All this can be done while the pump is running.

OBJECTS OF THE INVENTION

Accordingly, one of the objects of the present invention is to provide a vacuum hose manipulator tool that can be used by a pool technician to remotely connect the end of a vacuum hose of a portable vacuum cleaner to the suction outlet provided on the bottom of a skimmer of a swimming pool.

Another object of the present invention is to provide a vacuum hose manipulator tool that can be readily attached on a standard cuff provided on the end of a flexible vacuum hose of a portable vacuum cleaner for a swimming pool and used to assist a pool technician to remotely hook-up the end of the vacuum hose to the suction outlet of a skimmer.

Still another object of the present invention is to provide a vacuum hose manipulator tool that obviates the need for the pool technician to perform the task of hooking up a flexible vacuum hose of a portable vacuum cleaner to the suction outlet provided on the bottom of a skimmer of a swimming pool by having to extend his hand down into the water in the skimmer and getting it wet up to his elbow.

Other objects and advantages of the invention will become apparent from the following description when read in conjunction with the accompanying drawings.

DESCRIPTION OF THE PREFERRED EMBODIMENT

Figure 1:
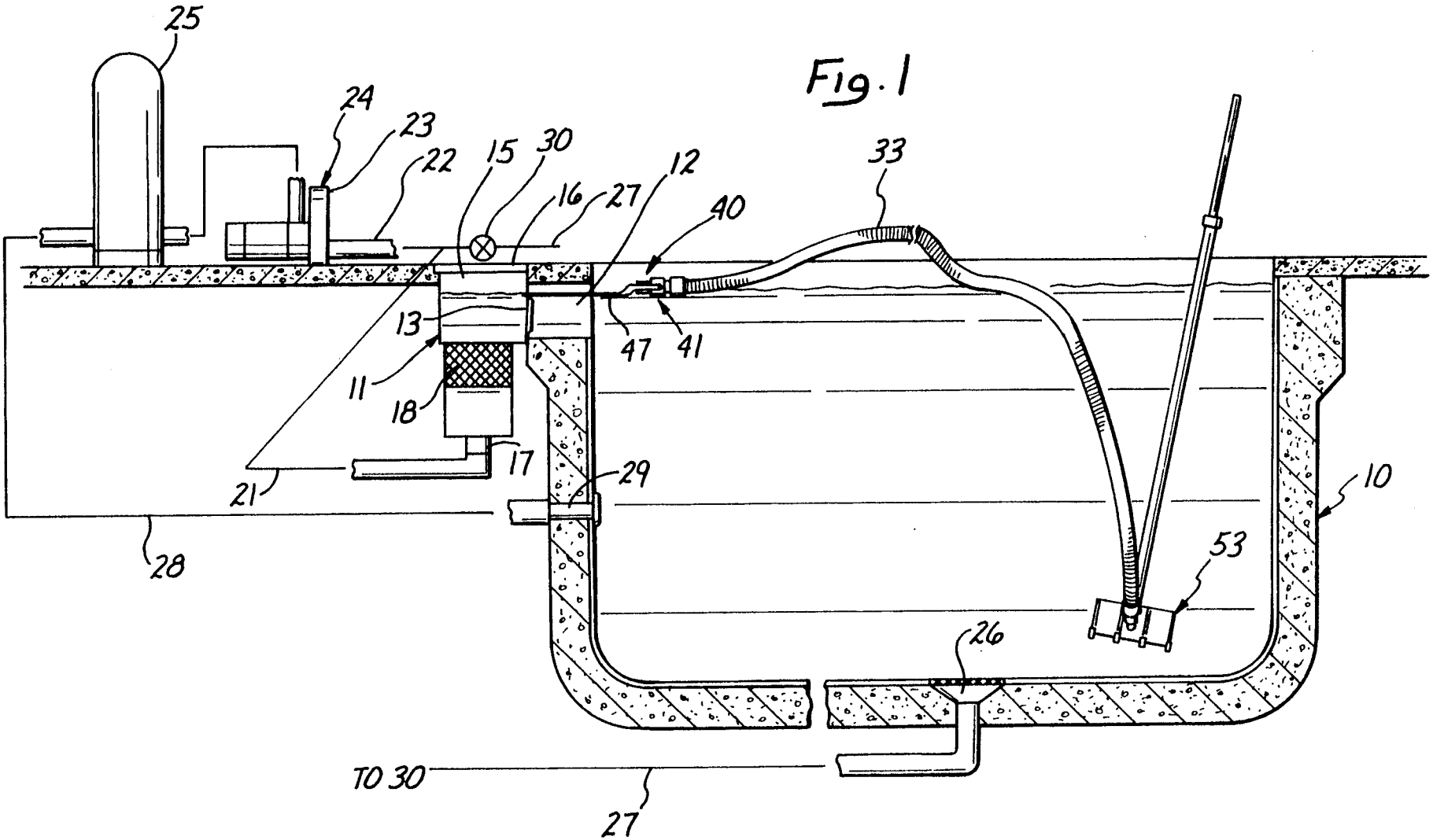
FIG. 1 illustrates a typical swimming pool installation provided with a skimmer adjacent the upper sidewall thereof and shows the manipulator tool of the present invention attached on the end of the flexible hose of a portable vacuum cleaner placed on the floor of the pool.

Reference will first be made to FIG. 1 showing a typical swimming pool installation 10 which includes a skimmer 11 having a skimming inlet 12 with a floating weir 13 therein and a bottom suction outlet 17. The skimmer 11 also has a top opening 15 covered by a lid 16. The suction outlet 17 has an internal wall with threads 19 on the upper portion thereof (FIG. 8) and is connected by a line 21 to the inlet 22 of a pump 24 provided with a strainer 23. A main drain suction outlet 26 on the bottom of the pool is connected by a line 27, having a manually controlled valve 30 therein, which joins to the inlet 22 of pump 24.

During the normal skimming operation of the swimming pool, a portion of the vacuum produced by the pump 24 draws water through the skimming inlet 12 from the surface of the water in the pool carrying floating debris, such as leaves, which is removed upon passing through a basket 18 provided in the skimmer 11. The remainder of the vacuum produced by the pump 24 is applied at the main drain suction outlet 26 and draws in water carrying silt and other debris from the floor of the pool. The water drawn from both sources after joining in the inlet 22 to the pump 24, passes through a filter 25 and the clean water is then carried back by a line 28 to openings provided on the sidewalls of the pool, only one of such openings 29 being shown in FIG. 1.

Figures 2, 3, 4, 4A:
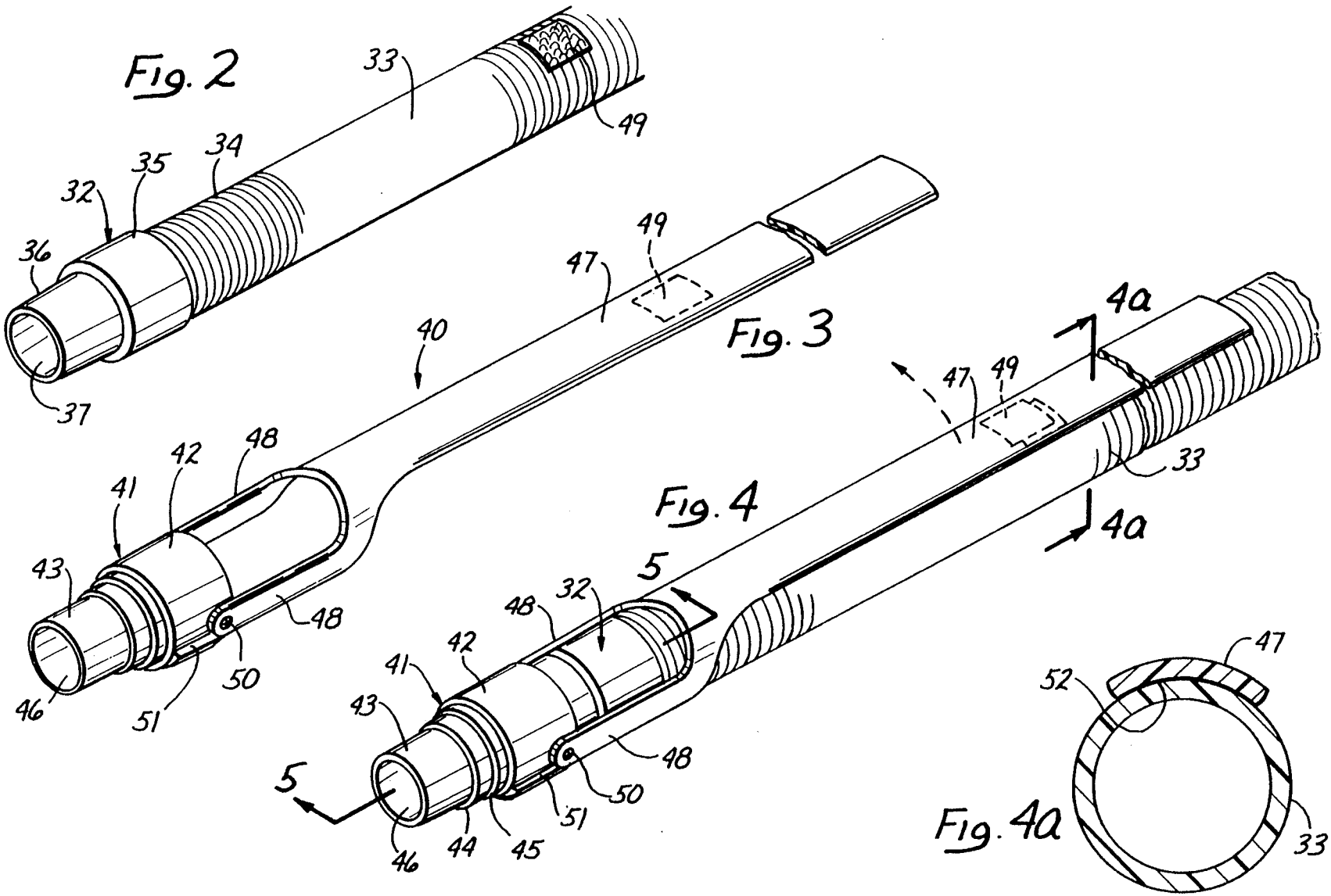
FIG. 2 is a perspective view of a standard cuff provided on the end portion of a flexible vacuum hose of a portable vacuum cleaner for a swimming pool.
FIG. 3 is a perspective view of the vacuum hose manipulator tool of the present invention.
FIG. 4 is a perspective view of the vacuum hose manipulator tool shown in FIG. 3 attached onto the standard cuff provided on the end of the flexible vacuum hose shown in FIG. 2.
FIG. 4*a* is a sectional view taken along line 4*a*—4*a* of FIG. 4.

Reference will next be made to FIG. 2 which shows a standard cuff 32 on the end of a flexible vacuum hose 33 as provided for a portable vacuum cleaner 53 placed on the floor of the swimming pool 10 (FIG. 1). The standard cuff 32 which is made of a durable plastic material has a back portion 35 with a cylindrical external surface which is larger in diameter then the external surface of the front portion 36 thereof, which latter is slightly tapered from the shoulder formed by the back portion 35 to the front end thereof. The back portion 35 on the standard cuff 32 has a generally cylindrical internal surface (FIG. 5) provided with a spiral groove 38 thereon for receiving a coil 34 of plastic material that surrounds the outer surface of the flexible vacuum hose 33. The internal surface 37 of the front portion 36 of the standard cuff 32 is cylindrically shaped.

Referring to FIG. 3, the hook-up manipulator tool 40 of the present invention comprises an auxiliary cuff 41 which is made of a durable plastic material. The auxiliary cuff has a back portion 42 that is formed with a cylindrically shaped external surface having a larger diameter than the front portion 43 thereof. The internal surface 46 of the back portion 42 (FIG. 5) is slightly tapered to match the tapered external surface of the front portion 36 of the standard cuff 32 so as to receive it with a slip fit. The external surface of the front end portion 43 of the auxiliary cuff 41 is initially provided with a tapered surface so that it can readily find its way into the threaded opening 19 of the suction outlet 17 of the skimmer 11 and then followed towards the rear thereof with a first stepped larger diameter surface defining a first shoulder 44 followed by a second stepped still larger diameter surface which defines a second shoulder 45. These two stepped surfaces are provided so that either of the shoulders 44 and 45 thereof will seal the auxiliary cuff 41 in the suction outlet 17 of the skimmer that may have either 1½ inch or a 2 inch internal threaded opening therein, by bearing down on the circumferential rim of the suction outlet 17 when the front portion 43 of the auxiliary cuff 41 is drawn into the suction outlet by the pull of the vacuum.

As further shown in FIG. 3, the vacuum hose manipulator tool 40 comprises, in addition to the auxiliary cuff 41, an elongated handle 47 having a pair of integral arms 48 formed on the inner end thereof. The pair of integral arms 48 are pivotally connected by screws 50 onto the sides of the back portion 42 of the auxiliary cuff 41. The elongated handle 47 is formed with a transversely curved inner surface 52 (FIG. 4*a*) which conforms to the outside circumference of the vacuum hose 33.

Figure 5:
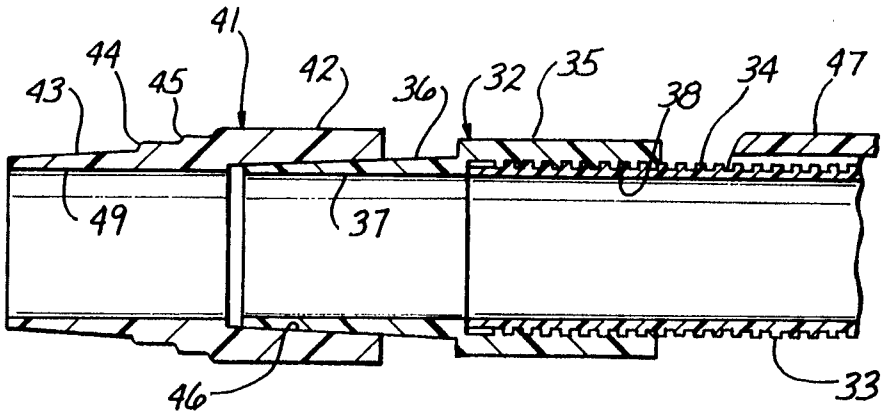
FIG. 5 is a cross sectional view of the manipulator tool attached on the standard cuff provided on the end of the flexible vacuum hose as taken along line 5—5 of FIG. 4.

As shown in FIGS. 4 and 5, the auxiliary cuff 41 of the manipulator tool 40 is attached to the standard cuff 32 on the end of the flexible hose 33 by fitting the tapered internal wall 46 on the back portion 42 of the auxiliary cuff 41 over the tapered external wall on the front portion 36 of the standard cuff 32. The standard cuff 32 is, in turn, attached by the spiral groove 38 on the internal surface of the back portion 35 thereof engaging the plastic coil 34 provided on the end portion of the flexible hose 33, as shown in FIG. 5.

Thus, as shown in FIG. 4, when the manipulator tool 40, attached to the standard cuff 32 on the end of the flexible hose 33, is not in use or the portable vacuum cleaner 53 is being transported, the elongated handle 47 is rotatably positioned by the pivotally held arms 48 to lie against the flexible hose 33 and is held in a rest position by a hook and loop fastener 49 of the type sold under the trademark "VELCRO". An axially aligned stop 51 is formed on each side of the back portion 42 of the auxiliary cuff at a location beneath the pivot screws 50 so as to limit the rotation of the elongated handle 47 to 180 degrees from its rest position against the flexible hose 33.

In the use of the manipulator tool 40 on the end of the flexible vacuum hose 33, as shown in FIG. 1, a pool technician places the portable vacuum cleaner 53 into the pool 10 with the tool 40 attached to the end of the flexible vacuum hose 33 thereof, as previously described. Also, the basket 18 is removed from the interior of the skimmer 11.

Figure 9:
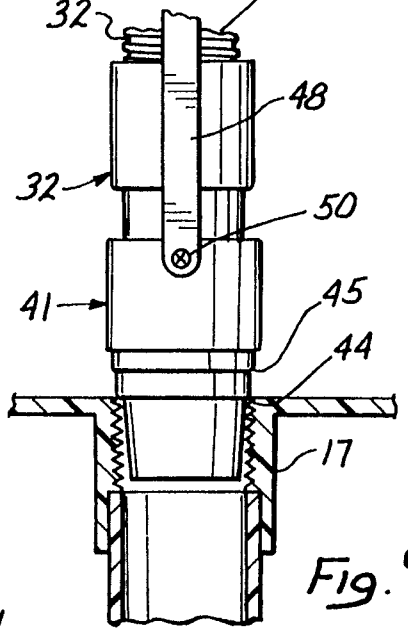
FIG. 9 is an enlarged view showing the auxiliary cuff of the manipulator tool engaged in the suction outlet of the skimmer.
Figure 6:
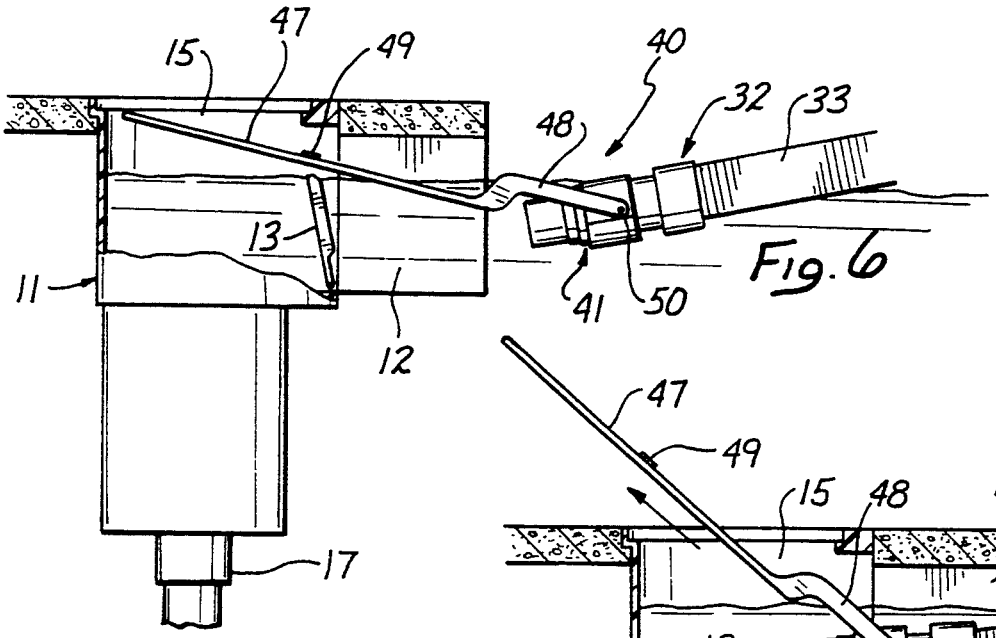
FIG. 6 is a view of the elongated handle on the manipulator tool swung forwardly on its pivoted arms so that it can be moved into the skimming inlet of the skimmer by the pool technician holding on to the submerged end portion of the hose with the fingers of one of his hands.
Figure 7:
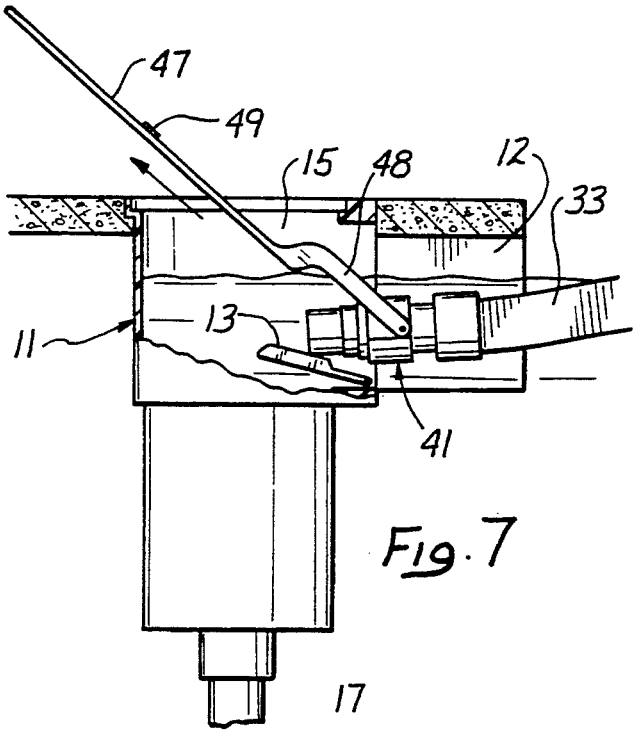
FIG. 7 is a view of the free end of the elongated handle of the manipulator tool being pushed up through the top opening of the skimmer by the pool technician holding onto the submerged end portion of the hose with the fingers of one of his hands.
Figure 8:
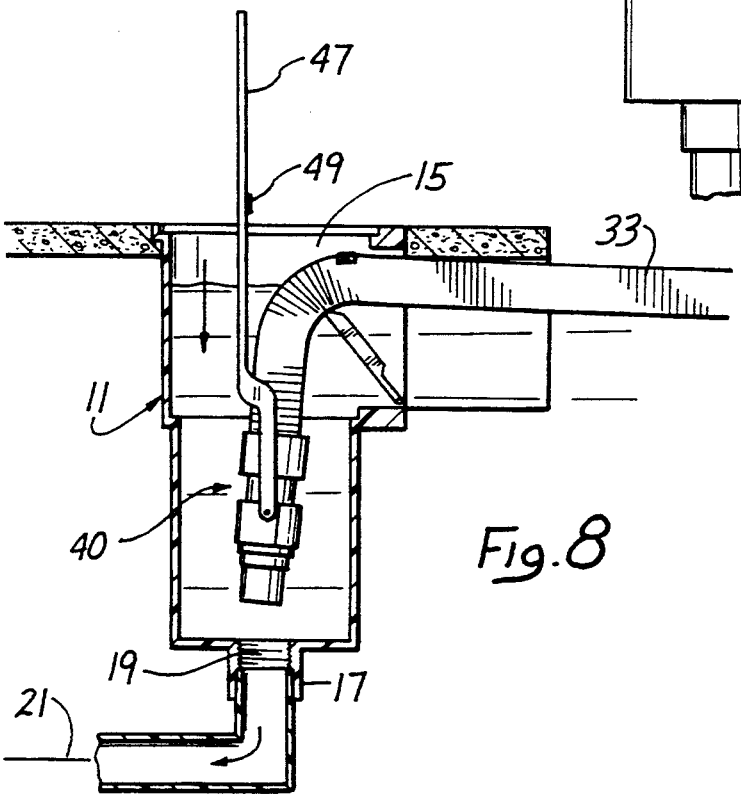
FIG. 8 is a view of the elongated handle of the hook-up manipulator tool extending out of the top opening of the skimmer so that the free end thereof can be held by the pool technician to enable him to push the auxiliary cuff down in the skimmer toward the suction outlet on the bottom thereof.

After pivotally swinging the elongated handle 47 as much as 180 degrees from its rest position against the flexible vacuum hose 33 and filling the hose including the standard cuff 32 and the auxiliary cuff 41 thereon with water, the pool technician, by holding onto the outer end portion of the hose 33 with the fingers of one of his hands then inserts the free end of the elongated handle 47, as shown in FIG. 6, through the skimming inlet 12 of the skimmer 11. It should be noted that when the elongated handle 47 is rotated on its pivotally held arms 48, the transversely curved outer surface on the handle 47 is positioned so that it lies above the upper edge of the weir 13 and slides with only a small contact thereon as it is pushed through the skimming inlet 12 into the skimmer. The pool technician then directs the elongated handle 47 upwardly, so that the end thereof extends up through the opening 15 on the top of the skimmer 11. As shown in FIG. 7, this enables the free end of the elongated handle 47, to be grasped by the other hand of the pool technician so that he can pull the auxiliary cuff 41 into the skimmer while keeping the open end of the auxiliary cuff at all times submerged in the water of the pool. The pool technician, by holding onto the outer end of the elongated handle 47, as illustrated in FIG. 8, then pushes down on the auxiliary cuff 41 so that its front end portion slips down into the suction outlet 17 of the skimmer until it engages shoulder 44, as shown in FIG. 9. As previously discussed, the flexible vacuum hose 33 now receives the full vacuum of the pump 24 for cleaning the floor of the pool.

To remove the auxiliary cuff 41 on the end of the flexible vacuum hose 33 from the suction outlet 17, after completing the vacuuming of the floor of the pool, the pool technician reverses the hook-up procedure, i.e., he pulls up on the end of the elongated handle 47 extending out of the top opening 15 of the skimmer 11 so as to disengage the end portion of the auxiliary cuff 41 from the suction outlet 17. Then, by use of the elongated handle 47, he directs the auxiliary cuff 41 towards the opening at the skimming inlet 12 where he is then able to hold on to the end of the handle 47 with the fingers of his other hand and draw the auxiliary cuff 41 and the elongated handle 47 completely out of the skimming inlet 12. It should be noted, as before, that when the elongated handle 47 is being pulled out of the skimmer 11 by way of its skimming inlet 12, the sliding of the outer transversely curved surface of the elongated handle 47 along the top of the weir 13 assures that it will not be caught thereon.

Figure 10:
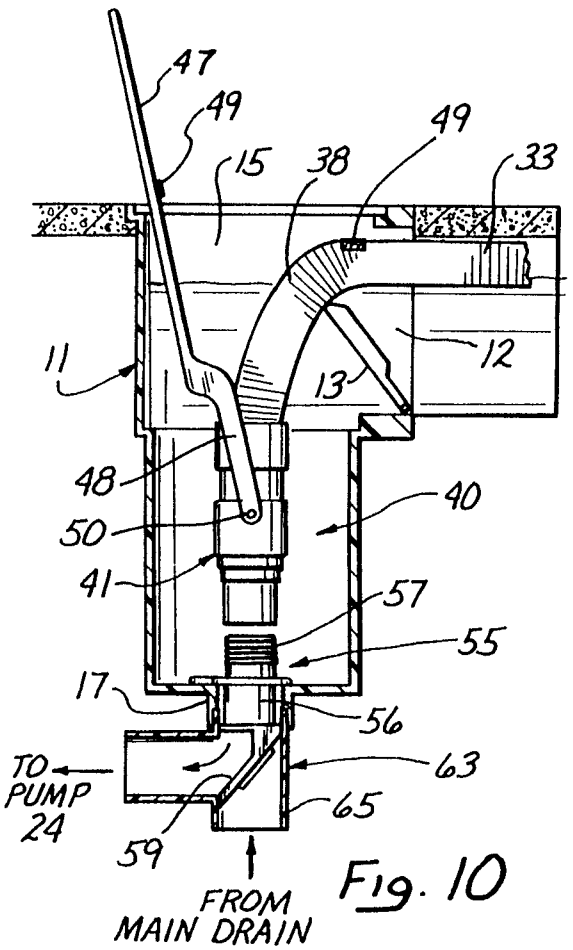
FIG. 10 is a view showing the auxiliary cuff on the manipulator tool having been positioned by the pool technician just above the upwardly extending portion of a diverter valve that is mounted in the suction outlet of the skimmer.
Figure 11:
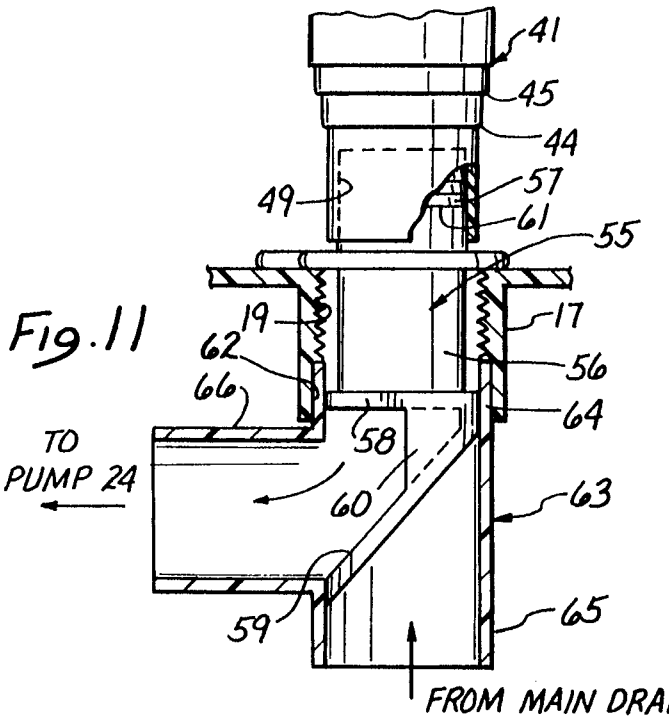
FIG. 11 is an enlarged view showing of the auxiliary cuff of the manipulator tool engaged over the upwardly extending portion of the diverter valve.

In the event the pool technician desires to remove the manipulator tool 40 off the end of the standard cuff 32 instead of merely rotating the elongated handle 47 to its rest position for storage on the hose 33, he simply grasps the auxiliary cuff 41 and pulls it off the standard cuff 32 with a slight twisting motion. As shown in FIG. 10, some swimming pools are designed to mount a conventional diverter valve 55 in the suction outlet 17 of the skimmer 11 for the purpose of regulating the proportion of the vacuum of the pump 24 that is made available at the suction outlet 17 of the skimmer 11 and the proportion of the vacuum of the pump 24 that is made available at the main drain suction outlet 26 on the bottom of the swimming pool. Thus, in such installations, the diverter valve 55 takes the place of the manual valve 30 included in the line 27 from the main drain suction outlet 26 to the inlet 22 of the pump 24, as previously described in connection with FIG. 1. As best shown in FIG. 11, the diverter valve 55 comprises a middle hollow cylindrical body portion 56 having an upwardly extending hollow upper cylindrical portion 57 formed with a series of spaced sawtooth grooves 61 that encircle the outer surface thereof. The diverter valve 55 also includes a semicircular wall portion 60 extending down from a circular border 58 provided on the bottom of the middle cylindrical portion 56 thereof. The semicircular wall portion 60 is provided with a bottom diagonal wall 59 that extends down from an edge thereof.

As shown in FIG. 11, in order to use the diverter valve 55 for regulating the proportion of the flow of water drawn from the suction outlet 17 of the skimmer and that drawn from main drain suction outlet 26 on the floor of the pool, the unthreaded bottom portion 62 of the suction outlet 17 of the skimmer 11 has the upper socket 64 of a tee fitting 63 connected thereto. Moreover, the lower socket 65 of the fitting 63 is connected to the line that connects to main drain suction outlet 26 of the pool 10 and the branch socket 66 of the tee fitting 63 is connected by the line 21 to the inlet 22 of the pump 24.

When the diverter valve 55 is mounted within the suction outlet 17 of the skimmer, a shoulder on the bottom of the upper cylindrical portion 57 thereof rests on the upper rim of the suction outlet 17 and its lower semicircular wall portion 60 extends into the interior of the tee fitting such that the bottom diagonal wall 59 thereon is disposed opposite the internal openings of both the upper socket 64 and the lower socket 65 of the tee fitting 63. Thus, as well known in the prior art, by rotating the diverter valve 55 in the suction outlet 17, the pool technician is able to regulate the proportion of the vacuum of the pump 24 that is applied to draw water into the skimming inlet 12 of the skimmer 10 and down through the skimmer suction outlet 17 and the proportion of the vacuum that is applied to draw water from the bottom main drain suction outlet 26 during the normal operation of the swimming pool.

Using this setup which employs a diverter valve 55, as shown in FIG. 10, when it is desired to vacuum the floor and sidewalls of the pool with a portable vacuum cleaner 53, the diverter valve 55 in suction outlet 17 of the skimmer 11 must be first rotatably set so that it completely closes off the opening in the socket 65 of the tee fitting 63 which joins the main drain suction outlet and the pump 24, as shown in FIG. 11. This rotation of the diverter valve 55 is accomplished without the need for the pool technician extending his hand up to his elbow into the water of the skimmer 11 by use of a diverter valve manipulator tool of the type disclosed in my copending application Ser. No. 087,909 filed Jul. 9, 1993.

The pool operator then inserts the elongated handle 47 of the manipulator tool 40 attached on the end of the flexible vacuum hose 33 of the portable pool cleaner 53 placed on the floor of the swimming pool 10 into the skimming inlet 12 of the skimmer, as previously described in connection with FIGS. 5, 6 and 7, so that he can, by holding onto the upper end of the elongated handle 47, extending up through the top opening 15 of the skimmer, position the auxiliary cuff 41 just above the diverter valve 55, as shown in FIG. 10. The pool technician then pushes the auxiliary cuff 41 down so that the cylindrical internal opening 49 on the front portion thereof slidingly fits over the end of the cylindrical portion 57 of the diverter valve 55 that extends above the suction outlet 17, as shown in FIG. 11. The vacuum hose 33 of the pool vacuum cleaner 53 is now provided with the full suction of the pump 24 as needed to enable the pool technician to clean the pool. To remove the auxiliary cuff 41 from its position over the cylindrical portion of the diverter valve, after completing the vacuuming of the floor of the pool, the pool technician merely reverses the hook-up procedure.

It should be especially noted that the hook-up of the standard cuff 32 on the end of the flexible vacuum hose 33 of the portable vacuum cleaner 53 to the suction outlet 17 of the skimmer as well as the removal therefrom can be carried out by use of the manipulator tool 41 while the circulating pump 24 is kept running. This is of great advantage because it eliminates the need to have to turn off the pump, which is usually remotely located from the pool 10, and then to turn it on again each time this is done.

While the invention has been concerned with a particular embodiment of the invention, it is to be understood that many modifications and variations in the construction and arrangement thereof may be provided for without departing from the spirit and scope of the invention or sacrificing any of its advantages. The invention is therefore considered as including all such possible modifications and variations coming within the legitimate and valid scope of the claims.

What is claimed is:

1. A manipulator tool for use in a swimming pool that has a skimmer with a skimming inlet communicating therewith and a suction outlet on the bottom thereof, said suction outlet connected to a pump located externally of the pool, and a portable pool cleaner located on the floor of the pool, said cleaner having connected thereto the inner end of a flexible vacuum hose, and a cuff having a back portion connected on the outer end of the hose, said manipulator tool comprising:

an auxiliary cuff having a back portion adapted to be attached to the front portion of the cuff on the outer end of the hose, the back portion of the auxiliary cuff having opposite sides;

an elongated handle having a transversely curved inner surface whose curvature is substantially the same as the curvature of the outer surface of the hose, said elongated handle having an inner end and an outer end;

a pair of integral side arms on the inner end of the elongated handle respectively pivotally connected to the opposite sides on the back portion of the auxiliary cuff; and a stop on the auxiliary cuff located adjacent the pivotal connection of the integral side arms to limit the rotation of said elongated handle;

whereby the elongated handle can be rotated on its integral side arms so that it lies in a rest position with the transversely curved inner surface thereof mating with the outer surface of the hose when not in use, and can be rotated away from its rest position so as to lie forwardly of the auxiliary cuff and pushed through the skimming inlet, while the auxiliary cuff remains submerged in the pool, causing the outer end of the elongated handle to extend out of a top opening of the skimmer so that it can be used to push the auxiliary cuff downwardly to hook up with the suction outlet on the bottom of the skimmer.

2. A manipulator tool as defined in claim 1 for use in a swimming pool that has a diverter valve mounted in the suction outlet on the bottom of the skimmer that is rotatably set to have all of the vacuum of the pump made available to draw water from the skimming inlet, said diverter valve having an upwardly extending cylindrical portion thereon, and wherein the manipulator tool comprises an auxiliary cuff having an integral cylindrical opening on the front portion thereof;

whereby when the outer end of the elongated handle extends out of the top opening of the skimmer it can be used to push the auxiliary cuff downwardly so that the internal cylindrical opening on the front portion thereof hooks up to the suction outlet of the skimmer by fitting over the upwardly extending cylindrical portion of the diverter valve mounted therein.

3. A manipulator tool for use in remotely hooking up an outer end of a flexible hose of a portable vacuum cleaner for a swimming pool to a suction outlet provided on the bottom of a skimmer for the pool, said skimmer provided with a skimming inlet having therein a floating weir with a top edge, said manipulator tool comprising:

a hollow coupler device having a cylindrical back portion adapted for attachment to the outer end of the hose and having a front portion adapted for engaging the suction outlet on the bottom of the skimmer, said cylindrical back portion having opposite sides thereon;

an elongated handle formed of a wall having transversely curved inner and outer surfaces thereon whose curvatures are substantially the same as the outer surface of the hose, said elongated handle having an inner end and an outer end;

a pair of opposing integral side arms on the inner end of the elongated handle having ends respectively pivotally connected to the opposite sides of the cylindrical back portion of the coupler device; and a radially projecting stop provided on at least one of the opposite sides of the cylindrical back portion of the coupler device adjacent the pivotal connection of an integral side arm to limit the rotation of the side arms and therefore the elongated handle forwardly of the coupler device;

whereby the elongated handle can be rotated on its integral side arms so that it lies in a rest position with the transversely curved inner surface of its wall mating with the outer surface of the hose when not in use, and can be rotated away from its rest position so as to lie forwardly of the coupler device and pushed through the skimming inlet with the transversely curved outer surface of its wall sliding with a point contact on the top edge of the floating weir, while the coupler device remains submerged in the pool, thereby enabling the outer end of the elongated handle to be directed upwardly into an opening on the top of the skimmer and used to remotely push the coupler device down into the skimmer so that the front portion thereof engages the suction outlet on the bottom of the skimmer.

4. A manipulator tool as defined in claim 3 wherein said stop on the coupler device limits the rotation of the elongated handle on its pair of integral side arms forwardly of the coupler device to not more than 180 degrees from its rest position.

5. A manipulator tool as defined in claim 3 wherein one part of a hook and loop fastener is provided on the inner surface of the wall of the elongated handle;

whereby when said coupler device is attached to the outer end of the hose, said one part of the detachable fastener on the inner surface of the elongated handle can engage a mating part of the hook and loop fastener provided on the surface of the hose to hold said elongated handle in its rest position.

* * * * *